US005881026A

United States Patent [19]

Baur et al.

[11] Patent Number: 5,881,026

[45] Date of Patent: Mar. 9, 1999

[54] SELF-COMPENSATING BALANCE SPRING FOR A MECHANICAL OSCILLATOR OF A BALANCE-SPRING/BALANCE ASSEMBLY OF A WATCH MOVEMENT AND PROCESS FOR MANUFACTURING THIS BALANCE-SPRING

[75] Inventors: Jacques Baur, Aubonne, Switzerland; Patrick Sol, Chanay, France; Pierre-Alain Walder, Confignon, Switzerland

[73] Assignee: Montres Rolex S.A., Geneva, Switzerland

[21] Appl. No.: 98,754

[22] Filed: Jun. 17, 1998

[30] Foreign Application Priority Data

Jun. 20, 1997 [EP] European Pat. Off. ..... 97810393

[51] Int. Cl.[6] ..... G04B 17/00; C21D 11/00

[52] U.S. Cl. ..... 368/169; 148/501; 148/672

[58] Field of Search ..... 368/139–140, 368/168–178; 148/407, 500, 501, 557, 668

[56] References Cited

U.S. PATENT DOCUMENTS 3,547,713 12/1970 Steinemann ..... 148/11.5

FOREIGN PATENT DOCUMENTS

| | | |
|---|---|---|
| 1291906 | 4/1969 | Germany . |
| 1558816 | 3/1972 | Germany . |
| 551 032 | 2/1970 | Switzerland . |
| 621 663 | 2/1981 | Switzerland . |

*Primary Examiner*—Vit Miska

*Attorney, Agent, or Firm*—Henderson & Sturm

[57] ABSTRACT

A self-compensating spring for a balance-spring for a balance-spring/balance assembly of a mechanical oscillator of a horological movement or of any other precision instrument, made of a paramagnetic Nb—Zr alloy containing between 5% and 25% by weight of Zr, obtained by cold rolling or cold drawing, and having a Young's modulus whose temperature coefficient (TCY) is adjustable by precipitation of Zr-rich phases in the Nb—Zr solid-solution. It contains at least 500 ppm by weight of an interstitial doping agent at least partly formed of oxygen.

20 Claims, 3 Drawing Sheets

SELF-COMPENSATING BALANCE SPRING FOR A MECHANICAL OSCILLATOR OF A BALANCE-SPRING/BALANCE ASSEMBLY OF A WATCH MOVEMENT AND PROCESS FOR MANUFACTURING THIS BALANCE-SPRING

The present invention relates to a self-compensating balance-spring for a balance-spring/balance assembly of a mechanical oscillator of a horological movement or of any other precision instrument, made of a paramagnetic Nb—Zr alloy containing between 5% and 25% by weight of Zr, obtained by cold rolling or cold drawing, and having a Young's modulus whose temperature coefficient (TCY) is adjustable by precipitation of Zr-rich phases in the Nb—Zr solid-solution, as well as a process for manufacturing a self-compensating spring for a mechanical oscillator assembly of a horological instrument.

It is known that the precision of mechanical watches is dependent on the stability of the inherent frequency of the balance-spring assembly's oscillator. When the temperature varies, the thermal dilatation of the balance-spring and of the balance itself, as well as variation of the spring's Young's modulus, alter the inherent frequency of this oscillator assembly and perturb the watches precision.

All methods proposed to compensate these frequency variations are based on the consideration that this inherent frequency depends exclusively on the relationship between the constant of the biasing torque exerted by the spring on the balance and the latter's moment of inertia, as indicated in the following relationship:

$$F = \frac{1}{2\pi} \sqrt{\frac{C}{I}} \tag{1}$$

where:

F=the oscillator's inherent frequency;

with C=constant of the balance-spring torque exerted by the oscillator's spring; and I=the moment of inertia of the oscillator's balance.

Since the discovery of Fe—Ni based alloys having a positive temperature coefficient (hereinafter TCY) of its Young's modulus, temperature compensation of the mechanical oscillator has been obtained by adjusting the spring's TCY as a function of the coefficients of thermal expansion of the spring and of the balance. By expressing the torque and the inertia in terms of the characteristics of the spring and the balance, and then deriving equation (1) relative to the temperature, we obtain the variation of the inherent frequency with temperature:

$$\frac{1}{F}\, dF/dT = \frac{1}{2}\left(\frac{1}{E}\,\frac{dE}{dT} + 3\alpha_s - 2\alpha_b\right) \tag{2}$$

where

E: Young's modulus of the oscillator spring;

$$\frac{1}{E}\,\frac{dE}{dT} = TCY = \text{temperature coefficient of the oscillator spring's Young's modulus;}$$

$\alpha_s$: coefficient of thermal expansion of the oscillator's spring; and $\alpha_b$: coefficient of thermal expansion of the oscillator's balance.

By adjusting the self-compensation factor A=½ (TCY+$3\alpha_s$) to the value of the balance's coefficient of thermal expansion, it is possible to nullify equation (2). Hence, the temperature variation of the mechanical oscillator's inherent frequency can be eliminated.

The coefficients of thermal expansion $\alpha_b$ of the materials most commonly employed for balances, such as alloys of copper, silver, gold, platinum or steel are situated in a range of the order of 10° to 20 ppm/° C. In order to compensate for the effects of temperature variations on the oscillator's inherent frequency, the alloys used for balance-springs must have a corresponding self-compensation factor A. To achieve the desired precision for watches, during manufacture it must be possible to control adjustment of the self-compensation factor to the desired value within a tolerance of several ppm/° C.

Ferromagnetic iron- nickel- or cobalt-based alloys used at present to manufacture balance-spring alloys have an abnormally high positive TCY within a range of about 30° C. above or below ambient temperature, by virtue of the fact that this range is in the proximity of the alloys' Curie temperature. Close to this temperature, magnetostrictive effects which reduce the Young's modulus of these alloys disappear, leading to an increase of the modulus. Apart from the fact that this temperature range is relatively narrow, these alloys are sensitive to the effects of magnetic fields. These fields irreversibly modify the balance-spring's elastic properties and as a result alter the mechanical oscillator's inherent frequency. Moreover, the elastic properties of ferromagnetic alloys vary with the degree of cold-working, which means that this parameter must be exactly controlled during manufacture of the balance-spring.

The required TCY values for balance-springs made from this group of alloys are adjusted by a thermal precipitation treatment which also determines the final shape of the balance-spring by creep.

CH-551 032 (D1), CH-557 557 (D2) and DE-C3-15 58 816 (D3) have already proposed paramagnetic alloys with a high magnetic susceptibility and a negative temperature coefficient of the susceptibility, as an alternative to ferromagnetic alloys for the manufacture of self-compensating balance-springs and precision springs. These alloys have an abnormally high positive TCY and provide the advantage that their elastic properties are insensitive to magnetic fields. Their magnetic properties depend on the texture created when the balance-spring is drawn, but depend only to a small degree on the degree of cold working, contrary to ferromagnetic alloys. Moreover, as mentioned in document D3, mechanical oscillators made with these alloys have a range of temperature compensation extending more than 100° C. above and below ambient temperature.

The physical reasons which create the abnormally high positive TCY of these paramagnetic alloys are explained in the above-mentioned documents. According to these documents, these alloys have a high density of electronic states at the Fermi level, as well as a strong electron-phonon coupling, which generates this abnormal behaviour of the TCY.

Document D3 in particular identifies the alloys Nb—Zr, Nb—Ti and Nb—Hf as being suitable for the manufacture of balance-springs of watch movement oscillators. Document D2 cites as example the alloy Nb—Zr25%. According to these documents, springs with an abnormally high positive TCY are manufactured from the alloy, annealed at high temperature then quenched rapidly in a manner to obtain a supersaturated solid-solution. The alloy in this state is then cold-formed by greater than 85%. This strong deformation induces a suitable texture and a positive value of the TCY. To adjust the TCY to the desired value, the alloy is finally heat treated in a temperature range allowing precipitation of the supersaturated solid-solution. The phases which precipitate out from the solid-solution have lower TCY values, which leads to a reduction of the overall TCY value allowing its adjustment.

DE-1 292 906 (D4) has also proposed binary Nb—Zr alloys containing between 15 and 35%, more particularly 25% by weight of Zr, for the manufacture of balance-springs for watch movement oscillators.

Balance-springs made with these binary alloys must be produced taking all necessary precautions to minimize contamination with oxygen. For this, the heat treatments used to produce precipitation in order to adjust the TCY are carried out in extreme vacuum conditions, and the alloys treated in this manner are moreover wrapped in titanium sheets which serve as an oxygen trap.

It is known that Nb—Zr alloys have a great affinity for oxygen which embrittles them. When polluted with oxygen, these alloys tend to rupture during the cold-forming operation required for the manufacture of balance-springs or other precision springs.

Because these alloys have a coefficient of thermal expansion of about 7 ppm/° C., equation (2) shows that the value of their TCY must be comprised in the range of about 0 to 20 ppm/° C. in order to achieve the same degree of compensation as for balance-springs commonly used in watches. However, as shown by the document "Anomalien der Temperaturabhängigkeit des Elastizizätsmoduls von NiobZirkonium-Legierung und reinem Niob" by H. Albert and I. Pfeiffer, in Z. Metallkde. 58, 311 (1967) (D5), binary alloys in solid-solution containing about 10% to 30% of Zr have TCY values at ambient temperature which are above the wanted values, as can also be seen from our measurements represented in the diagram of accompanying FIG. 1.

To reduce the value of the TCY, a precipitating heat treatment must be carried out in the biphase zone of the binary Nb—Zr phase. Various heat treatments have been carried out at temperatures comprised between 650° and 800° with a view to reducing the TCY value of alloys containing 10% to 30% of Zr.

The values obtained after treatments at 650° to 750° C. are given in the diagram of FIG. 2. These heat treatments strongly reduce the TCY of alloys containing more than 23% by weight of Zr. However, it is observed that for concentrations of Zr below 23%, the TCY cannot be reduced to the values required for balance-springs, even with very long treatment times.

This is confirmed by document D5 (one of the authors of this document D5 is the inventor of document D4), where treatments for 64h at 600° C. were carried out for alloys comprising 19% to 33% by weight of Zr. For concentrations greater than or equal to 25% by weight of Zr, the temperature coefficient at ambient temperature drops during the heat treatment to very negative values, whereas, still according to this document D4, for concentrations from 19% to 22%, values close to 0 ppm/° C. are obtained. These values, after heat treatment, are lower than those measured during out tests, the results of which are reported in FIG. 2. This difference, is explained by the lower temperature reported in document D5 for the heat treatment.

The measured TCY values for alloys containing from 19% to 22% by weight of Zr and treated for 64h at 600° C. would be suitable for the manufacture of balance springs. However, tests we have carried out show that these treatment conditions unfortunately do not enable forming of the spring into its spiral shape by creep when the concentration of Zr is less than 20% by weight. Furthermore, the duration of the heat treatment needed to obtain a TCY suitable for self-compensating balance-springs is much too long for industrial production.

Hence, the tests we have carried out, and which are confirmed by document D5, show that binary Nb—Zr alloys containing less than 23% by weight of Zr (see FIG. 2) are unsuitable for the manufacture of self-compensating balance-springs for mechanical oscillators of watch movements, contrary to what is affirmed in D4 without substantiation by any practical tests (it being noted that the inventor of D4 is a co-author of D5).

Whereas all of the state of the art relating to the manufacture of Nb—Zr alloys advocates minimising pollution by oxygen by every means possible in order to avoid fragilisation leading to ruptures during the deforming operations, as is particularly emphasised in document D4 which specifically recommends carrying out the heat treatment of the binary Nb—Zr alloys in such a manner as to maintain the oxygen concentration as low as is permitted by the manufacturing processes, we have chosen to dope the Nb—Zr alloys with oxygen to facilitate precipitation of Zr rich phases. It is known from "Natur, Grösse und Verteilung von Gitterstörungen und ihr Einfluss auf Hochfeldeigenschaften des Typ-III-Supraleiters Nb—Zr25"by H. Hillmann and I. Pfeiffer, in Z. Metallkde. 58, 129 (1967) (D6), that oxygen, even in low concentrations of about 1000 ppm by weight, modifies the phase diagram of binary Nb—Zr alloys containing 25% by weight of Zr and accelerates the precipitation of Zr rich phases.

Contrary to what has been accepted for over 25 years in the state of the art relating to the manufacture of self-compensating balance-springs made of Nb—Zr alloys for mechanical oscillators of horological instruments, the inventors of the present invention have discovered that the doping of these alloys containing between 5% and 25% by weight of Zr has proven to be extremely beneficial to the extent that this enables the precipitation of Zr rich phases in these alloys by heat treatments carried out at temperatures and for durations compatible with the manufacture of such balance-springs.

Consequently, an object of the present invention consists in obviating at least in part the drawbacks of self-compensating balance-springs for mechanical oscillators, notably for watch movements. More particularly, this invention aims to remedy the above-indicated drawbacks associated with self-compensating balance-springs made of paramagnetic alloys more specifically Nb—Zr alloys.

To achieve this, this invention firstly concerns a self-compensating balance-spring of the above-mentioned type for a mechanical oscillator of a watch movement or other precision instrument, made of a paramagnetic Nb—Zr alloy containing between 5% and 25% by weight of Zr, as defined in claim 1.

This invention also concerns a process for manufacturing such a self-compensating balance-spring for a mechanical oscillator of a watch movement, according to claim 7.

Further features of this invention are set out in the dependent claims attached to the two above-mentioned principal claims relating to a self-compensating balance-spring and its manufacturing process.

The present invention has considerable advantages in that, for the first time, it provides a truly industrial solution by which it is possible to deliberately and precisely adjust the TCY of a paramegnetic alloy and hence the self-compensation factor of a self-compensating balance-spring of mechanical oscillator of a watch movement made from such alloy. Up to the present, for the reasons set out above, it was impossible, due to the fact that an interstitial oxygen-containing doping agent was not contemplated, to manufacture such balance-springs of binary Nb—Zr alloy containing below 20% by weight of Zr. Furthermore, as will be explained below, it has been observed that in the range of these alloys comprising between 20 and 25% by weight of Zr, adjustment of the TCY by heat treatment is very dependent on the concentration of oxygen. Given that with the proposals made in the state of the art, in particular that of document D4, there was no control of the oxygen concentration, this oxygen concentration fluctuated as a function of the operating conditions between the production of two series of balance-springs, so it was impossible, without knowledge of the oxygen content and its role in the adjustment of the TCY, to control the TCY and hence the self-compensation factor of the balance-spring with precision.

Moreover, the ferromagnetic alloys in use at present are only self-compensating in a small range of temperature, and their Young's modulus undergoes irreversible variations for example when subjected to magnetic fields, whereby the inherent frequency of the mechanical oscillator associated with such a balance-spring is liable to undergo variation with time.

The solution proposed by the present invention consequently represents a decisive improvement compared to state-of-the-art self-compensating balance-springs, because such inventive balance-springs enable a precise adjustment of their self-compensation factor, the Young's modulus of the paramagnetic alloy furthermore being insensitive to magnetic fields and to the degree of cold-working and, finally, the range in which the TCY remains abnormally positive and enables a self-compensating effect is increased from about 30° to about 100° C. above or below ambient temperature.

In the field of self-compensating balance-springs made of paramagnetic alloy for mechanical oscillators of watch movements, this invention can therefore be described without exaggeration as a substantial progress, because this invention for the first time ever enables the manufacture of such springs with a Zr content comprised between 5% and 20%, in which range the precipitation of Zr—rich phases is easy to control and only slightly sensitive to an oxygen-containing interstitial agent. It is also the first ever proposal to use such alloys with a Zr content comprised between 20 and 25% by weight with the possibility to control adjustment of the TCY by controlling the amount of an oxygen-containing interstitial agent in the alloy.

Further features and advantages will become apparent from the following description as well as the accompanying drawings which illustrate a series of explanatory graphs relating to Nb—Zr alloys.

Figure 1:
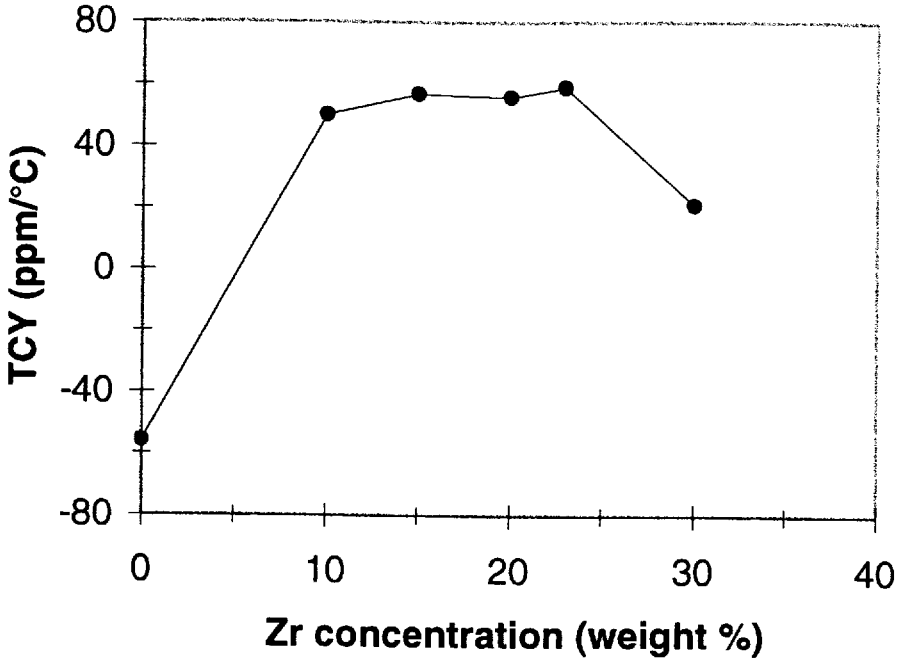
FIG. 1 is a graph of the TCY at ambient temperature of binary Nb—Zr alloys in solid solution in the cold-worked state.
Figure 2:
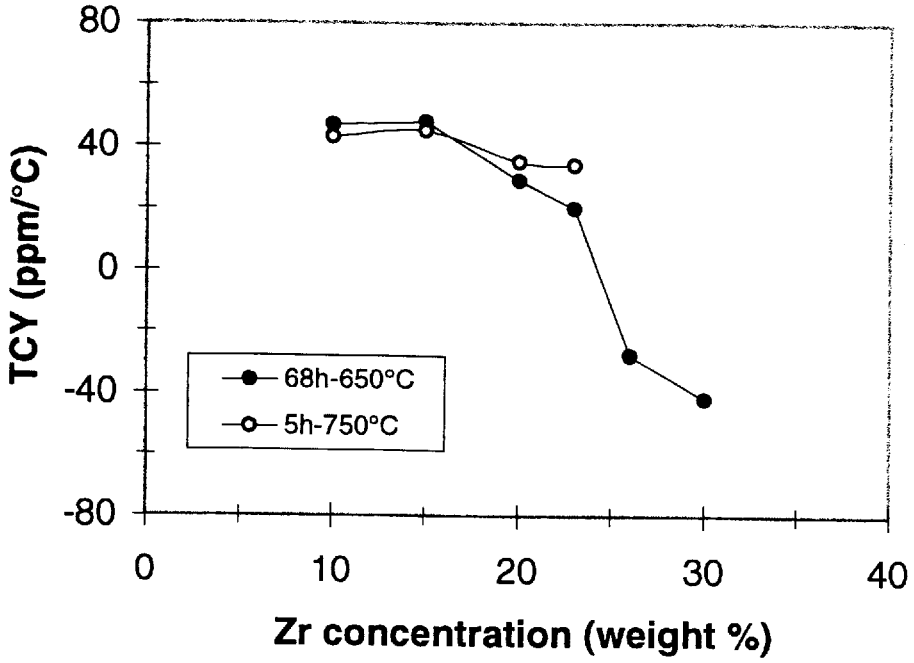
FIG. 2 is a graph of the TCY at ambient temperature of binary Nb—Zr alloys after tempering.
Figure 3:
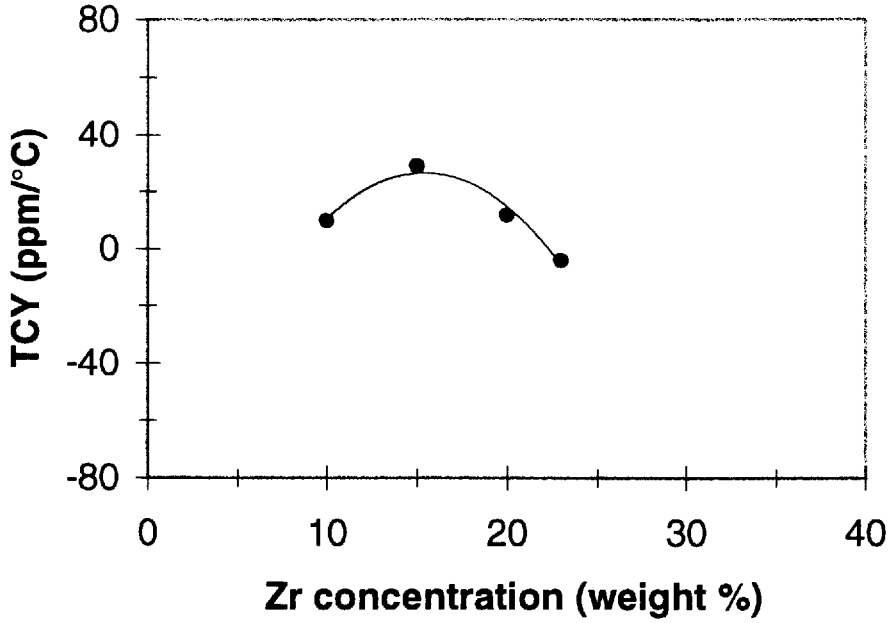
FIG. 3 is a graph of the TCY at ambient temperature of Nb—Zr—O alloys doped with about 1000 ppm by weight of oxygen.

FIG. 3 illustrates the case of alloys containing 10%–23% of Zr with about 1000 ppm by weight of oxygen, which have undergone a tempering treatment for 3 h at 750° C. It can be seen from this graph that the tempering allows adjustment of the TCY to the values desired for self-compensating balance-springs (0 to 20 ppm/° C.), for alloys containing 10%–13% and 18%–22% of Zr. Generally speaking, by doping with above 600 ppm of oxygen, it is possible to adjust the TCY between 0 and 20 ppm/° C. for all Nb alloys containing 5% to 23% by weight of Zr. The recommended tempering temperatures are comprised between 700° and 850° C. These temperatures and treatment times simultaneously enable the shape of the balance-spring to be set by creep. By means of oxygen doping, the concentration of Zr required to manufacture these balance-springs can thus be reduced and, as will be seen, it is easier to control the TCY when the Zr concentration is less than 20% by weight. Moreover, the temperature of the treatment used to control the TCY is sufficiently high to set the shape of the spring by creep, which was not previously possible with Zr concentrations below 23% by weight, which required temperatures of about 600° C., i.e. below the temperature for setting the shape of the balance-spring by creep.

Figure 4:
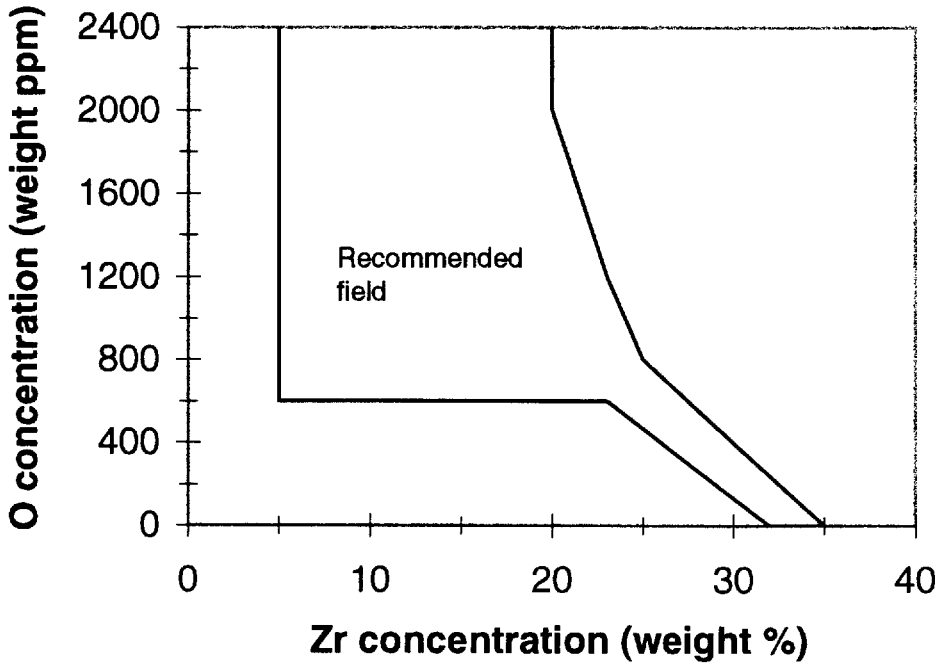
FIG. 4 is a graph illustrating the domain of Nb—Zr—O contents useful for balance-springs.
Figure 5:
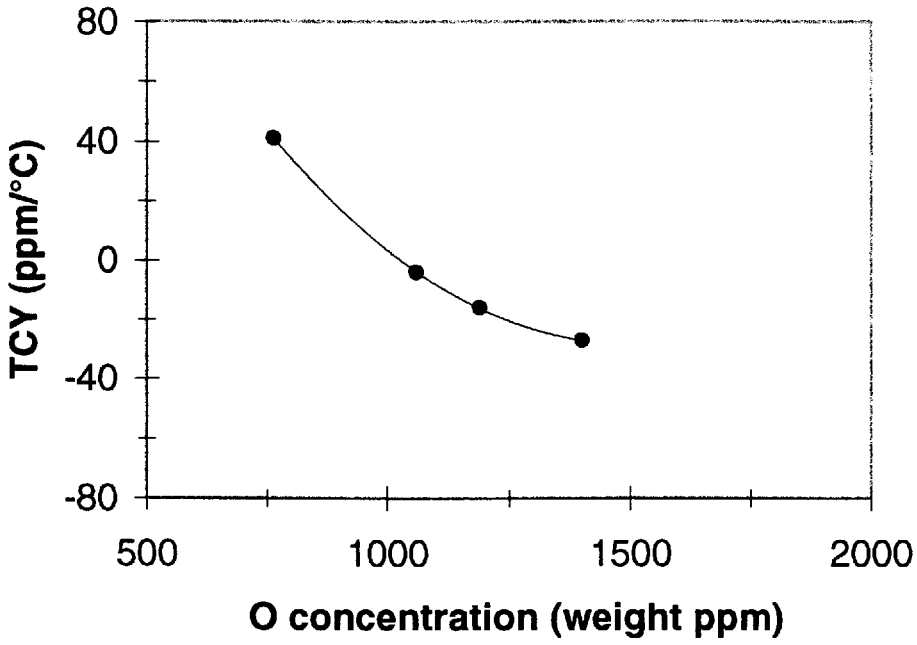
FIG. 5 is a graph illustrating the TCY at ambient temperature of the alloy Nb—Zr23%, tempered 3 h at 750° C., as a function of the oxygen content.

The optimum concentration of oxygen to be introduced into the alloy depends on the amount of Zr. Three domains of Zr concentration can be distinguished, as schematically illustrated in FIG. 4:

a) In the first domain which can be situated between 25% and 35% by weight of Zr, the oxygen concentration must be maintained as low as possible, namely less than about 500 ppm by weight. Higher concentrations would lead to rupture of the ribbon during drawing, and precipitation of Zr rich phases much too quickly to enable control of the desired TCY value for a self-compensating balance-spring.

b) Between 25% and 20% by weight of Zr, the oxygen concentration must be maintained in a narrow band increasing from about 500–800 ppm by weight for the 25% alloy to about 600–2000 ppm by weight for the alloy containing 20% of Zr. Below these amounts of doping agent, precipitation of the Zr-rich phases is too slow. Above, this precipitation is too fast to enable the manufacture of self-compensating balance-springs with a controllable TCY. In this domain of Zr concentration, we have observed a great dependence of the TCY on the oxygen concentration. For example, the graph of FIG. 5 illustrates the TCY values obtained with Nb—Zr23% by weight alloys after 3 h at 750° C., for different oxygen concentrations. It can be seen that the TCY varies from too-high positive values to too-negative values over several tens of ppm by weight of oxygen. This sensitivity necessitates a precise control of the oxygen concentration to guarantee reproducible TCY values of the self-compensating balance-springs manufactured from these alloys, which is difficult to reproducibly achieve.

c) In the domain comprised between 5% and 20% by weight of Zr, at least 600 ppm by weight of oxygen must be introduced to enable precipitation of Zr rich phases and hence controllable adjustment of the TCY value. For these Zr concentrations, a very small sensitivity of the TCY value is observed relative to the concentration of oxygen in the alloy. No greater concentration of oxygen was observed in the alloys made during our tests. Such limit must surely exist, if for no other reasons because of the fragility of the alloys when the oxygen concentration increases too much, but it did not affect our experiments. Taking these observations into account, we estimated that providing care is taken to at least reach the above-mentioned lower limit, it was unnecessary to define an upper limit which would have no practical consequence for the desired result, because this result can be obtained in a perfectly reproducible manner without knowing this upper limit, and taking into account the fact that in any event this is the domain of the Nb—Zr alloy wherein the oxygen concentration is least critical. Typically, we can state that it is possible, in all cases, to achieve the aim of the invention by doping the Nb—Zr alloy in this domain (5%–20% of Zr) with between 600 and 1500 ppm by weight of oxygen.

Above 25% by weight of Zr on the one hand it is difficult to work the alloy and, on the other hand, it is very difficult to reproducibly control the TCY because of the increased rate of precipitation. To the contrary, it has been found that it is much easier to work Nb—Zr alloys comprising less than 25%, preferably less than 20% by weight of Zr.

It has been observed that the resistance to deformation decreases and the ductility increases as the Zr concentration decreases. However, the mechanical properties of the finished balance-spring deteriorate. These mechanical properties can be improved by adding to the alloy at least one hardening element, selected from the following elements in proportions comprises between 0.01% and 5% by weight : Be, Al, Si, Ge, Sc, Y, La, Ti, Hf, V, Ta, Cr, Mo, W, Mn, Re, Fe, Ru, Os, Co, Rh, Ir, Ni, Pd, Pt, Cu, Ag, Au.

Doping elements other than oxygen, such as nitrogen, carbon, boron or phosphorous can be added either at the same time as or after the oxygen doping treatment used to permit adjustment of the TCY by the precipitation of Zr rich phases. As will be seen later, a quantity of nitrogen is nearly always found in the alloy in addition to oxygen.

When the shaping of the balance-spring has been completed, an additional doping operation to harden the balance-spring can be carried out with a gas containing at least one of the above-mentioned elements. This additional treatment will of course increase the balance-spring's brittleness, but this is less critical once its shaping is completed. Consequently, it can be advantageous to increase the finished balance-spring's hardness and mechanical properties, even though the doping with oxygen to adjust the TCY already contributes to structural hardening of the balance-spring. Of course, this treatment must be carried out at a temperature that does not reach the TCY adjustment temperature, i.e. a temperature not exceeding 650° C.

Examples

A series of examples relating to the manufacturing process of the self-compensating balance-springs according to the present invention will now be described. First, we will set out the general operating conditions applying to all of the examples, then a Table relating to different alloys made under the stated operating conditions.

The Nb—Zn alloy is cast under extreme vacuum in an electron beam melting furnace The bars obtained are then sheathed, for example in a sheath made of an alloy of copper, nickel or stainless steel, using a customary procedure for this type of Nb—Zr alloy, to keep the alloy out of contact with oxygen. These bars are then cold laminated or cold drawn to a diameter comprised between 0.05 and 1.5 mm, with intermediate annealing operations if needed.

The wire obtained is next removed from its protective sheath and then undergoes a doping operation with oxygen using a known technique, either anodic oxidation, or thermal oxidation. In the case of anodic oxidation, the concentration of oxygen introduced is controlled by selecting the diameter of the wire, the temperature and the electrolyte composition.

For thermal oxidation, the concentration of oxygen introduced is controlled by selecting the diameter of the wire, the temperature, the type of oxidising gas and its pressure, as well as the duration of the treatment.

After the oxygen doping operation, the wire is cold formed into a cross-sectional shape corresponding to that of a balance-spring. This wire is then wound into a spiral shape, then heat treated to define its shape by creep and to adjust the TCY to the required value as a function of the type of alloy, according to the above-mentioned specifications.

Several examples relative to thermal doping of various alloys and different wire diameters with oxygen are given in Table I below.

It is understood that if, according to the previously-mentioned possibility, a second doping treatment is carried out on the finished self-compensating barrel-spring, the quantities of oxygen and if appropriate nitrogen could be substantially greater than the quantities reported in Table I. However, this Table indicates quantities that are sufficient to produce an adjustment of the balance-spring's TCY, generally between 0 and 20 ppm° C., by controlled precipitation of Zr rich phases. As previously indicated, in the alloy range from 5% to 20%, the upper amount of the interstitial doping agent is not critical, but it must be situated above a lower limit situated about 600–800 ppm by weight.

TABLE I

| Zr (%) Weight | ϕ (mm) | Temp. (°C.) | Duration (min.) | Gas | Pressure (Pa) | Oxygen (ppm) | Nitrogen (ppm) |
|---|---|---|---|---|---|---|---|
| 23 | 1 | 1080 | 120 | $N_2/H_2$ | $10^5$ | 1100 | 1200 |
| 20 | 0.9 | 1100 | 60 | — | $10^{-4}$ | 1200 | 150 |
| 20 | 0.15 | 450 | 2 | air | $10^5$ | 900 | 70 |
| 15 | 0.25 | 450 | 3 | air | $10^5$ | 800 | 50 |
| 10 | 0.25 | 450 | 3 | air | $10^5$ | 950 | 50 |

However, once the TCY has been adjusted, in order to improve the mechanical properties of the finished balance-spring it is possible, whatever may be the alloy composition, to add at least one of the above-mentioned interstitial agents in a second doping operation. During this second operation, other elements diffusable into the balance-spring alloy, such as carbon, boron or phosphorous, may also be added to harden it.

As previously mentioned, other means for improving the mechanical properties of the balance-spring could be employed, such as incorporating in the alloy a given quantity of one of the elements listed in Table II, in an amount varying from 0.01% to 5% by weight.

TABLE II

| Element | Group | Hardness of Nb according to the literature |
|---|---|---|
| Be | IIa | |
| A1 | IIIa | * |
| Si | IVa | |
| Ge | IVa | * |
| Sc | IIIb | |
| Y | IIIb | |
| La | IIIb | |

TABLE II-continued

| Element | Group | Hardness of Nb according to the literature |
|---|---|---|
| Ti | IVb | * |
| Hf | IVb | * |
| V | Vb | * |
| Ta | Vb | * |
| Cr | VIb | * |
| Mo | VIb | * |
| W | VIb | * |
| Mn | VIIb | |
| Re | VIIb | |
| Fe | VIIIb | * |
| Ru | VIIIb | |
| Os | VIIIb | |
| Co | VIIIb | |
| Rh | VIIIb | |
| Ir | VIIIb | |
| Ni | VIIIb | * |
| Pd | VIIIb | |
| Pt | VIIIb | |
| Cu | Ib | * |
| Ag | Ib | |
| Au | Ib | |

Certain of the elements listed in Table II are reported in the literature as hardening agents, and further elements amongst those listed have been selected as a function of their phase diagram with Nb.

We claim:

1. A self-compensating balance-spring for a balance-spring/balance assembly of a mechanical oscillator of a precision instrument in particular a horological movement, made of a paramagnetic Nb—Zr alloy containing between 5% and 25% by weight of Zr and having a Young's modulus whose temperature coefficient (TCY) is such that it can substantially nullify the expression $$\frac{1}{E}\ \frac{dE}{dT} + 3\alpha_s - 2\alpha_b$$

where $$\frac{1}{E}\ \frac{dE}{dT} = TCY = \text{temperature coefficient of the oscillator spring's Young's modulus;}$$

E Young's modulus of the oscillator spring;

$\alpha_s$: coefficient of thermal expansion of the oscillator's spring; and $\alpha_b$: coefficient of thermal expansion of the oscillator's balance, characterized by the fact that it contains at least 500 ppm by weight of an interstitial doping agent at least partly formed of oxygen.

2. The balance-spring according to claim 1, characterised in that it comprises between 5% and 20% by weight of Zr and at least 600 ppm by weight of said interstitial doping agent.

3. The balance-spring according to claim 1, characterized in that, to control precipitation of Zr rich phases in the Nb—Zr solid-solution when said Nb—Zr alloy comprises between 20% and 25% by weight of Zr, the amount of said interstitial doping agent varies from 600 to 2000 ppm by weight for a concentration of 20% by weight of Zr to 500 to 800 ppm by weight for a concentration of 25% by weight of Zr.

4. The balance-spring according to claim 1, characterised in that the proportion of oxygen in said interstitial doping agent is comprised between 20% and 100% by weight.

5. The balance-spring according to claim 1, characterised in that, in addition to said doping agent for controlling the precipitation of Zr rich phases in the Nb—Zr solid-solution, it further comprises an amount of at least one hardening doping agent selected from the following elements: oxygen, nitrogen, carbon, boron and phosphorous.

6. The balance-spring according to any preceding claim, characterised in that it further comprises between 0.01% and 5% by weight of at least one element selected from : Be, Al, Si, Ge, Sc, Y, La, Ti, Hf, V, Ta, Cr, Mo, W, Mn, Re, Fe, Ru, Os, Rh, Ir, Ni, Pd, Pt, Cu, Ag, Au.

7. Process for manufacturing a self-compensating balance-spring made of a Nb—Zr alloy comprising 5% to 25% of Zr for a mechanical balance/balance-spring oscillator of a precision instrument in particular a horological movement, wherein a bar is formed from said alloy, this bar is transformed into a wire having a diameter comprised between 0.05 and 1.5 mm by cold rolling or cold drawing in the absence of oxygen, the diameter of this wire is reduced by cold rolling or cold drawing and shaped into a ribbon suitable for the balance-spring, this ribbon is wound into the shape of a spiral and submitted to at least one heat treatment under a controlled pressure and/or controlled atmosphere to reduce the temperature coefficient of the Young's modulus (TCY) by the controlled precipitation of Zr rich phases and to define the shape of the balance-spring, characterised in that the wire contains an interstitial agent in an amount producing the controlled precipitation of Zr rich phases, and the wire thus obtained is heated between 650° C. and 880° C. for 1 h to 24 h, to adjust the TCY to the desired value.

8. The process according to claim 7, characterised in that a Nb—Zr alloy comprising between 5% and 20% by weight of Zr is formed and the amount of said interstitial agent in said wire is adjusted by doping with at least 600 ppm in an oxygen-containing atmosphere.

9. The process according to claim 7, characterised in that a Nb—Zr alloy comprising between 20% and 25% by weight of Zr is formed and the amount of said interstitial agent in said wire is adjusted by doping from 600 to 2000 ppm by weight for a concentration of 20% by weight of Zr to 500 to 800 ppm by weight for a concentration of 25% by weight of Zr.

10. The process according to claim 7, characterised in that said ribbon wound into a spiral shape is placed under vacuum to carry out said heat treatment.

11. The process according to claim 7, characterized in that after heat treatment to adjust the TCY and define the shape of the self-compensating balance-spring, said spring undergoes a hardening heat treatment at a temperature below 650° C. in an atmosphere containing a partial pressure of a gas containing at least one element capable of diffusing into the balance-spring.

12. The process according to claim 11, characterized in that said elements are selected from: oxygen, nitrogen, carbon, boron and phosphorous.

13. The balance-spring according to claim 2, characterised in that, the proportion of oxygen in said interstitial doping agent is comprised between 20% and 100% by weight.

14. The balance-spring according to claim 3, characterised in that the proportion of oxygen in said interstitial doping agent is comprised between 20% and 100% by weight.

15. The balancing-spring according to claim 2, characterised in that, in addition to said doping agent for controlling the precipitation of Zr rich phases in the Nb—Zr solid-solution, it further comprises an amount of at least one hardening doping agent selected from the following elements: oxygen, nitrogen, carbon, boron and phosphorous.

16. The balancing-spring according to claim 3, characterised in that, in addition to said doping agent for controlling the precipitation of Zr rich phases in the Nb—Zr solid-solution, it further comprises an amount of at least one hardening doping agent selected from the following elements: oxygen, nitrogen, carbon, boron and phosphorous.

17. The balancing-spring according to claim 4, characterised in that, in addition to said doping agent for controlling the precipitation of Zr rich phases in the Nb—Zr solid-solution, it further comprises an amount of at least one hardening doping agent selected from the following elements: oxygen, nitrogen, carbon, boron and phosphorous.

18. The balance-spring according to claim 2, characterized in that it further comprises between 0.01% and 5% by weight of at least one element selected from: Be, Al, Si, Ge, Sc, Y, La, Ti, Hf, V, Ta, Cr, Mo, W, Mn, Re, Fe, Ru, Os, Rh, Ir, Ni, Pd, Pt, Cu, Ag, Au.

19. The balance-spring according to claim 3, characterized in that it further comprises between 0.01% and 5% by weight of at least one element selected from: Be, Al, Si, Ge, Sc, Y, La, Ti, Hf, V, Ta, Cr, Mo, W, Mn, Re, Fe, Ru, Os, Rh, Ir, Ni, Pd, Pt, Cu, Ag, Au.

20. The balance-spring according to claim 4, characterized in that it further comprises between 0.01% and 5% by weight of at least one element selected from: Be, Al, Si, Ge, Sc, Y, La, Ti, Hf, V, Ta, Cr, Mo, W, Mn, Re, Fe, Ru, Os, Rh, Ir, Ni, Pd, Pt, Cu, Ag, Au.

* * * * *

UNITFD STATES PATENT AND TRADEMARK OFFICE

CERTIFICATE OF CORRECTION

PATENT NO. : 5,881,026
DATED : March 9, 1999
INVENTOR(S) : Jacques BAUR, Pierre-Alain WALDER & Patrick SOL It is certified that error appears in the above-indentified patent and that said Letters Patent is hereby corrected as shown below:

On the Title page: at item 73, entitled Assignee, after Montres Rolex S.A., Geneva, Switzerland, please insert --Manufacture Des Montres Rolex S.A., Bienne, Switzerland--, as correctly indicated on the Notice of Recordation of Assignment, Reel 9476, Fram 0636.

Signed and Sealed this

Ninth Day of May, 2000

*Attest:*

Q. TODD DICKINSON

*Attesting Officer*

*Director of Patents and Trademarks*